US005259625A

United States Patent [19]

Fanning

[11] Patent Number: 5,259,625

[45] Date of Patent: Nov. 9, 1993

[54] APPARATUS AND METHOD FOR PLAYING A COURT GAME

[76] Inventor: Michael S. Fanning, 3745 Rhodes Ave., Charlotte, N.C. 28210

[21] Appl. No.: 985,799

[22] Filed: Dec. 1, 1992

[51] Int. Cl.[5] ..... A63B 71/02

[52] U.S. Cl. ..... 273/411; 273/371

[58] Field of Search ..... 273/411, 26 R, 26 A, 273/29 R, 371

[56] References Cited

U.S. PATENT DOCUMENTS

| | | | |
|---|---|---|---|
| 2,473,893 | 6/1949 | Lyle | 273/371 X |
| 3,229,975 | 1/1966 | Tompkins et al. | 273/371 X |
| 3,727,069 | 4/1973 | Crittenden, Jr. et al. | 273/371 X |
| 3,807,858 | 4/1974 | Finch | 273/371 X |
| 4,204,683 | 5/1980 | Filippini et al. | 273/371 |
| 4,375,289 | 3/1983 | Schmall et al. | 273/411 X |
| 4,398,724 | 8/1983 | Wilson et al. | 273/411 |
| 4,422,647 | 12/1983 | Wilson et al. | 273/411 |
| 4,699,386 | 10/1987 | Carzino | 273/411 X |
| 4,834,392 | 5/1989 | Nixon | 273/411 |
| 4,866,414 | 9/1989 | Diaconu et al. | 273/29 R X |
| 5,018,746 | 5/1991 | Cardoza, Jr. et al. | 273/411 |
| 5,058,899 | 10/1991 | Jackson et al. | 273/411 |
| 5,059,944 | 10/1991 | Carmona | 273/29 R X |
| 5,112,061 | 5/1992 | Lamle | 273/411 |
| 5,138,322 | 8/1992 | Nuttall | 273/29 R X |
| 5,150,895 | 9/1992 | Berger | 273/29 R |

*Primary Examiner*—William H. Grieb

*Attorney, Agent, or Firm*—Shefte, Pickney & Sawyer

[57] ABSTRACT

A novel apparatus and method for playing such a field or court game wherein electronic sensing beams are utilized to distinguish proper and improper flight of the game object between opposing players and, in turn, to assist in determining scoring of the game.

24 Claims, 1 Drawing Sheet

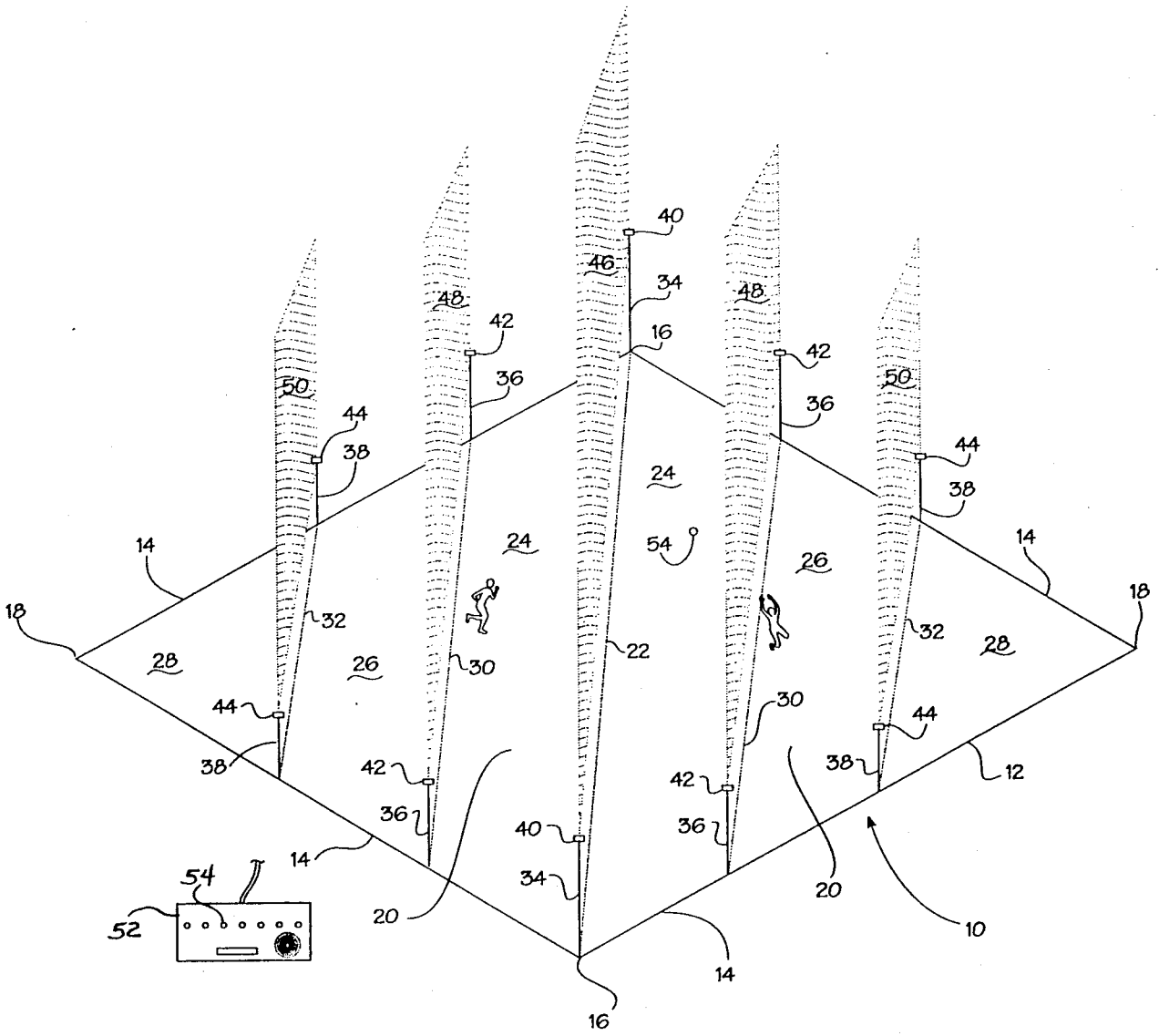
10
12
14
16
18
20
22
24
26
28
30
32
34
36
38
40
42
44
46
48
50
52
54

APPARATUS AND METHOD FOR PLAYING A COURT GAME

FIELD OF THE INVENTION

The present invention relates generally to field or court games and, more particularly, to a novel apparatus and method for playing such a game wherein electronic sensing beams are utilized to distinguish proper and improper flight of a game object between opposing players and, in turn, to assist in determining scoring of the game.

BACKGROUND OF THE INVENTION

Court or field games are relatively common wherein a ball or other object is hit, batted or thrown between opposing players within a defined court area back and forth over a net, line or other device or means separating the players. Tennis and volleyball are perhaps the most popular of such games. Other lesser known examples of such field or court games are disclosed in U.S. Pat. Nos. 4,375,289, 4,422,647, 4,834,392, 5,018,746, 5,058,899 and 5,112,061.

SUMMARY OF THE INVENTION

It is an object of the present invention to provide a novel field or court game in the general nature of the aforementioned games but which utilizes currently available electronic technology to establish one or more electronic sensing beams instead of a physical structure such as a net to distinguish between proper and improper flights of a ball or other game object between opposing players. By eliminating the need for a physical net or like structure, the limitations and restrictions such structures necessarily impose on developing variations of known court and field games are removed. Thus, the present invention provides significantly expanded possibilities for developing new and challenging variations of court and field games of the general type to which the invention relates, e.g., the ability to provide multiple electronic divisions not only between opposing player regions of the court or field but also within each player's own respective region of the court or field.

Briefly summarized, according to one aspect of the present invention, a novel apparatus is provided for playing a court game based upon airborne flight of a game object back and forth between two players. The present apparatus includes a court of a predetermined area divided into two opposing player regions, the court preferably being of a predetermined symmetrical shape defined by a continuous outermost boundary line with the two opposing player regions of identical size and shape defined between the outermost boundary line and a centerline bisecting the court area. An electronic arrangement or other suitable means establishes at least one planar sensor beam traversing the court upwardly from a predetermined minimum elevation thereabove and extending in substantially perpendicular relation to the court. For example, in one preferred embodiment, a central sensor beam is provided substantially coplanar with the centerline separating the two player regions. This sensing arrangement is adapted to detect passage of the object through the planar beam during flight of the object.

Preferably, each player's region of the court is subdivided into at least an inner subregion adjacent the centerline and an outer subregion separated by a dividing line traversing the player region in parallel relation to the centerline. In turn, a pair of secondary planar sensing beams are established to traverse the court upwardly from a second predetermined minimum elevation which is less than that of the central sensing beam, the secondary sensing beams being respectively disposed above the two player regions at equal spacings from opposite sides of the central beam in parallel relation thereto and in coplanar relation to the respective dividing lines across each player region. Each secondary beam is similarly adapted for independently detecting passage of the object through the beam during flight of the object.

The present invention also contemplates the possibility that tertiary sensing beams may be established at a third predetermined minimum elevation above the respective player regions at equal spacings from the respective secondary sensing beams outwardly thereof from the central sensing beam.

The present invention further provides a novel method of playing a court game between two opposing players, utilizing the above described apparatus. Specifically, game play is initiated and continues by the players alternately directing the game object to travel in airborne flight from within each player's respective region into the other player's region. The basic objective of the game is for each player to attempt to cause the game object to land within the opposing player's region subject to the requirement that the object must pass upon each exchange through at least the sensing beam which immediately precedes the opposing player's subregion in which the object is landed or its flight otherwise terminates (e.g., by being caught by the opposing player). Thus, upon each flight of the object between the player regions, the central, secondary and tertiary sensing beams serve to detect whether the object passes through the respective beams and, in turn, determines some aspect of continuing play of the game, e.g., scoring, exchange of service (i.e., the right to initiate a series of exchanges of the object), etc.

In one contemplated embodiment of the present apparatus and method, the court is diamond-shaped with the centerline intersecting side apexes of the boundary line.

The game object may be a ball or other item which is configured to be catchable and throwable by the players. In such case, the present method contemplates that a score would be awarded to a player when a flight of the object initiated by such player lands in the opposing player's region after passing through at least the immediately preceding planar beam.

BRIEF DESCRIPTION OF THE DRAWING

The accompanying drawing is a schematic perspective view illustrating one embodiment of the apparatus of the present invention, adapted for use by two opposing players.

BRIEF DESCRIPTION OF THE DRAWING

Referring now to the accompanying drawing, one contemplated embodiment of the game apparatus and method of the present invention is illustrated and basically utilizes a diamondshaped court 10 defined by a continuous outer boundary line 12 comprising four line segments 14 meeting at two laterally opposed side boundary apexes 16 and two longitudinally opposed end boundary apexes 18. The court 10 is divided into two identical equilaterally triangular player regions 20 by a centerline 22 extending between the side apexes 16. Each player region 20 is further subdivided into inner, middle and outer subregions 24,26,28, respectively, by two additional dividing lines 30,32 traversing each player region 20 in parallel relation to the centerline 22.

Five pair of upright support posts 34,36,38, respectively, extend vertically from the outer boundary line 12 of the court 10 at the side apexes 16 and at the opposite ends of each dividing line 30,32, each pair of posts carrying at their respective upper ends electronic sensing devices, indicated only representatively at 40,42,44, respectively, which employ conventional electronic technology suitable to establish a respective sensing beam, representatively indicated at 46,48,50, respectively, within a planar field traversing the court 10 between the respective posts and extending vertically above the respective ends of the posts to be capable of detecting passage of an object through the beam or field. The beam-generating devices 40,42,44 are respectively connected to a control panel 52 equipped with one or more suitable indicators 54 adapted to produce an audible and/or visual signal when an object passes through any of the individual beams or fields. As more fully explained hereinafter, the control panel 52 will be monitored by a game umpire or referee during ongoing play to enable such person to ascertain when an object passes through one of the beams or fields 46,48,50. In this regard, an audible signal is preferred so that the umpire can listen for the signal without diverting his or her eyes from the on-going game. Different sounds may be generated upon passage through the individual beams 46,48,50 to enable the referee or umpire to ascertain which beam or beams have been penetrated. As an alternative, or in addition, lights or other visual indicators may be provided for indicating penetration of individual respective beams 46,48,50.

As indicated in the drawing, the respective pairs of posts 34,36,38 are selected to be of differing heights, with the centermost posts 34 having the greatest height and the intermediate posts 36 and outermost posts 38 being of progressively lesser heights. Thus, the beams or fields 46,48,50 established by the beam generating devices 40,42,44 mounted on the posts 34,36,38 extend upwardly from differing lowermost or minimum respective elevations determined by the differing heights of the posts. At a minimum, the height of the shortest posts 38 should be greater than the height of the players so that player movement within the court is not mistakenly detected by the beams for passage of the game object. Alternatively, the game object may be equipped with a detectable element or formed of a detectable material and the beam generating devices may be constructed to specifically detect such element or material as distinguished from a player, thereby to enable the post heights to be lower and the court to be reduced in size.

The present game is played by two players using a ball or another similar object 54 of a configuration suitable to be directed in airborne flight by the players back and forth between their respective player regions 20, preferably by the players throwing and catching the object 54 although it is contemplated that the game can also be played with paddles, racquets or bats by which the players hit the object 54 between themselves. During each exchange of throws of the object 54 as play of the game progresses, the sensing capabilities of the beam-generating devices 40,42,44 together with the signaling capabilities of the control panel 52 enable the referee or umpire to immediately evaluate whether each throw has been properly made through the appropriate beam or beams 46,48,50, so that play can progress rapidly with minimal interruption.

The basic objective of the game is for each player to throw the ball or other object 54 from a point within such player's own player region 20 into the opposing player's region 20 by passing through at least the sensing beam 46, 48 or 50 which immediately precedes, in the object's path of flight, the opponent's particular subregion 24,26,28 into which the object is thrown, i.e., the subregion in which flight of the object terminates. The specific objective of each player upon initiating such a throw is to attempt to cause the thusly-thrown object to land within the opponent's region 20 without being caught or batted out of bounds by the opponent, while the specific objective of each player receiving such a thrown object is to prevent the object from touching the surface of the court 10 within the receiving player's region 20, e.g., by catching the object cleanly or batting the object from mid-flight out of bounds.

Play of the game is initiated by one player making an initial throw from his outermost subregion 28 into the opponent's region 20, with play continuing for so long as each player makes a proper throw, i.e., penetrating at least the center beam 46 or the opponent's beam 48 or 50 immediately preceding the subregion 24,26,28 into which the ball is thrown, and also for so long as each receiving player cleanly catches or otherwise prevents the opponent's throws from landing within the court. A score is awarded to a player each time he or she is successful in landing a properly thrown ball within the boundaries of the opponent's player region 20, i.e., when a player successfully lands the ball 54 in the opponent's inner subregion 24 after passing through the central beam 46 or when the player lands the ball 54 in the opponent's intermediate subregion 26 after passing through the opponent's intermediate beam 48 or when a player lands the ball 54 in the opponent's outer subregion 28 after passing through the opponent's outer beam 50.

Of course, as those persons skilled in the art will readily recognize, numerous variations of the present game are possible. By way of example and without limitation, a score could also be awarded to a player when his or her opponent fails to make a proper throw of the ball 54 through the appropriate beam 46, 48 or 50. It is also contemplated that various other court shapes and sizes, with a greater or lesser number of sensing beams 46,48,50, may be utilized and, depending upon the size and shape of the court, the game may be played by more than one player in each player region 20. Differing rules may be utilized to determine when service of the ball, i.e., initiation of play by one player making a first throw of the ball into the opponent's region, is to be switched between the players. For example, play may progress with each player having a certain predetermined successive number of serves after which the opponent receives a corresponding number of serves, and so on, as in the game of table tennis. Alternatively, service may switch back and forth between the players randomly with each service being awarded to the player scoring on the preceding exchange. The scoring rules could also be established to award a score to a player only when serving. Thus, a non-serving player who is successful in a given exchange would not be awarded a score but instead would be entitled to initiate service on the next exchange with the opportunity of scoring during the succeeding exchange, in similar manner to the game of volleyball. Specific rules could be applied to permit a player catching a throw from the opponent to move anywhere within the catching player's region before making a return throw of the ball or, alternatively, players could be required to return throw of the ball from the point at which it is caught. In either case, a maximum time limit could be placed on each player to return throw of the ball after catching it.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for playing a court game comprising:

an object which is capable of airborne flight back and forth between two players, a court of a predetermined area divided into two opposing player regions, and means for establishing at least one planar sensing beam traversing the court upwardly from a predetermined minimum elevation thereabove, the planar beam extending in substantially perpendicular relation to the court, the sensing beam means being adapted for detecting passage of the object through the planar beam during flight of the object as the players alternately direct the object to travel in airborne flight from each player's respective region into the opposing player's respective region.

2. Apparatus for playing a court game according to claim 1, wherein the court is of a predetermined symmetrical shape defined by a continuous outermost boundary line and the opposing player regions are of identical size and shape defined between the outermost boundary line and a centerline bisecting the court area.

3. Apparatus for playing a court game according to claim 2, wherein the sensing beam means comprises means for establishing a central planar sensing beam substantially coplanar with the centerline separating the two player regions.

4. Apparatus for playing a court game according to claim 3, wherein the sensing beam means further comprises means for establishing a pair of secondary planar sensing beams each traversing the court upwardly from a second predetermined minimum elevation thereabove which is less than the first-mentioned predetermined minimum elevation of the central sensing beam, the secondary sensing beams being respectively disposed above the two player regions at equal spacings from opposite sides of the central planar sensing beam in parallel relation thereto, each secondary sensing beam being adapted for independently detecting passage of the object through the beam during flight of the object.

5. Apparatus for playing a court game according to claim 4, wherein the sensing beam means further comprises means for establishing a pair of tertiary planar sensing beams each traversing the court upwardly from a third predetermined minimum elevation thereabove which is less than the second predetermined minimum elevation of the secondary sensing beams, the tertiary sensing beams being respectively disposed above the two player regions at equal spacings from the respective secondary sensing beams outwardly thereof from the central sensing beam and in parallel relation to the central and secondary sensing beams, each tertiary sensing beam being adapted for independently detecting passage of the object through the beam during flight of the object.

6. Apparatus for playing a court game according to claim 2, wherein the court is diamond-shaped, the boundary line defining opposite side apexes and opposite end apexes, the centerline intersecting the side apexes.

7. Apparatus for playing a court game according to claim 1, wherein the object is configured to be catchable and throwable by the players.

8. A method of playing a court game between two opposing players, comprising the steps of:

providing a court of a predetermined area divided into two opposing player regions, establishing at least one planar sensing beam traversing the court upwardly from a predetermined minimum elevation thereabove and extending in substantially perpendicular relation to the court, initiating and continuing play by the players alternately directing an object to travel in airborne flight from within each player's respective region into the other player's region, and upon each flight of the object between the player regions, detecting whether the object passes through the planar beam.

9. A method of playing a court game according to claim 8 and further comprising determining an aspect of ongoing play of the game following each flight of the object between the players according to whether the flight of the object passes through the planar beam.

10. A method of playing a court game according to claim 8, wherein each player initiate a flight of the object by throwing the object and the opposing player attempts to prevent the thrown object from landing in such player's respective player region.

11. A method of playing a court game according to claim 8 and further comprising awarding a score to a player when a flight of the object initiated by such player lands in the opposing player's region after passing through the planar beam.

12. A method of playing a court game according to claim 8, wherein the step of providing a court comprises forming the court of a predetermined symmetrical shape defined by a continuous outermost boundary line and forming the opposing player regions of identical size and shape defined between the outermost boundary line and a centerline bisecting the court area.

13. A method of playing a court game according to claim 12, wherein the step of establishing at least one planar beam comprises establishing a central planar sensing beam substantially coplanar with the centerline separating the two player regions.

14. A method of playing a court game according to claim 12, wherein the court is diamond-shaped, the boundary line defining opposite side apexes and opposite end apexes, the centerline intersecting the side apexes.

15. A method of playing a court game between two opposing players, comprising the steps of:

providing a court of a predetermined area and a predetermined symmetrical shape defined by a continuous outermost boundary line and having two opposing player regions of identical size and shape defined between the outermost boundary line and a centerline bisecting the court area, with each player region being subdivided into an inner subregion adjacent the centerline and an outer subregion separated by a dividing line traversing the player region in parallel relation to the centerline, initiating and continuing play by the players alternately directing an object to travel in airborne flight from within each player's respective region into the other player's region, and upon each flight of the object between the player regions, detecting whether the object passes through at least one of a central planar field traversing the court upwardly from a first predetermined minimum elevation thereabove and a secondary planar field traversing the player region receiving the object upwardly from a second predetermined minimum elevation thereabove which is less than the first minimum elevation, the central planar field extending in substantially perpendicular relation to the court and substantially coplanar with the centerline separating the two player regions and the secondary planar fields respectively extending above the two player regions in substantially perpendicular relation to the court and substantially coplanar with the respective dividing lines thereof.

16. A method of playing a court game according to claim 15 and further comprising determining an aspect of ongoing play of the game following each flight of the object between the players according to the detecting step.

17. A method of playing a court game according to claim 15 and further comprising determining an aspect of ongoing play of the game following each flight of the object between the players according to whether the flight of the object passes through the planar field which, in the flight of the object, immediately precedes the receiving player's subregion in which flight of the object terminates.

18. A method of playing a court game according to claim 15, wherein each player initiates a flight of the object by throwing the object and the opposing player attempts to prevent the thrown object from landing in such player's respective player region.

19. A method of playing a court game according to claim 15 and further comprising awarding a score to a player when a flight of the object initiated by such player lands in the opposing player's inner subregion after passing through the central planar field and when a flight of the object initiated by such player lands in the opposing player's outer subregion after passing through the opposing player's respective secondary planar field.

20. A method of playing a court game according to claim 15, wherein the court is diamond-shaped, the boundary line defining opposite side apexes and opposite end apexes, the centerline intersecting the side apexes.

21. Apparatus for playing a court game comprising:

an object which is capable of airborne flight back and forth between two players, a court of a predetermined area divided into two opposing player regions, and apparatus for establishing at least one planar sensing beam traversing the court upwardly through a predetermined elevational range thereabove, the planar beam extensing in substantially perpendicular relation to the court, the sensing beam apparatus being adapted for detecting passage of the object through the planar beam during flight of the object as the players alternately direct the object to travel in airborne flight from each player's respective region into the opposing player's respective region.

22. A method of playing a court game between two opposing players, comprising the steps of:

providing a court of a predetermined area divided into two opposing player regions, establishing at least one planar sensing beam traversing the court upwardly through a predetermined elevational range thereabove and extending in substantially perpendicular relation to the court, initiating and continuing play by the players alternately directing an object to travel in airborne flight from within each player's respective region into the other player's region, and upon each flight of the object between the player regions, detecting whether the object passes through the planar beam.

23. Apparatus for playing a court game between two opposing players, comprising:

an object which is capable of airborne flight back and forth between the two players, a court of a predetermined area and a predetermined symmetrical shape defined by a continuous outermost boundary line and having two opposing player regions of identical size and shape defined between the outermost boundary line and a centerline bisecting the court area, with each player region being subdivided into an inner subregion adjacent the centerline and an outer subregion separated by a dividing line traversing the player region in parallel relation to the centerline, and apparatus for establishing a central planar field traversing the court upwardly through a first predetermined elevational range thereabove and two secondary planar fields respectively traversing the player regions upwardly through a second predetermined elevational range thereabove, the central plane field extending in substantially perpendicular relation to the court and substantially coplanar with the centerline separating the two player regions and the secondary planar fields respectively extending above the two player regions in substantially perpendicular relation to the court and substantially coplanr with the respective dividing lines thereof.

24. A method of playing a court game between two opposing players, comprising the steps of:

providing a court of a predetermined area and a predetermined symmetrical shape defined by a continuous outermost boundary line and having two opposing player regions of identical size and shape defined between the outermost boundary line and a centerline bisecting the court area, with each player region being subdivided into an inner subregion adjacent the centerline and an outer subregion separated by a dividing line traversing the player region in parallel relation to the centerline, initiating and continuing play by the players alternately directing an object to travel in airborne flight from within each player's respective region into the other player's region, and upon each flight of the object between the player regions, detecting whether the object passes through at least one of a central planar field traversing the court upwardly through a first predetermined elevational range thereabove and a secondary planar field traversing the player region receiving the object upwardly through a second predetermined elevational range thereabove which is less than the first elevational range, the central planar field extending in substantially perpendicular relation to the court and substantially coplanar with the centerline separating the two player regions and the secondary planar fields respectively extending above the two player regions in substantially perpendicular relation to the court and substantially coplanar with the respective dividing lines thereof.

* * * * *

UNITED STATES PATENT AND TRADEMARK OFFICE

CERTIFICATE OF CORRECTION

PATENT NO. : 5,259,625

DATED : November 9, 1993

INVENTOR(S) : Michael S. Fanning

It is certified that error appears in the above-identified patent and that said Letters Patent is hereby corrected as shown below:

Column 2, line 22, after "above" insert -- - --.

Column 2, line 60, delete "BRIEF DESCRIPTION OF THE DRAWING" and insert therefor -- DESCRIPTION OF THE PREFERRED EMBODIMENT --.

Column 2, line 64, delete "diamondshaped" and insert therefor -- diamond-shaped --.

Column 3, line 26, delete "ongoing" and insert therefor -- on-going --.

Column 3, line 43, after "beam" insert -- - --.

Column 8, line 12, delete "extensing" and insert therefor -- extending --

Column 8, line 54, delete "plane" and insert therefor -- planar --.

Column 8, line 60, delete "coplanr" and insert therefor -- coplanar --.

Signed and Sealed this

Thirteenth Day of September, 1994

*Attest:*

*Attesting Officer*

Bruce Lehman

BRUCE LEHMAN

*Commissioner of Patents and Trademarks*